US005981857A

United States Patent [19]

Mapson

[11] Patent Number: 5,981,857

[45] Date of Patent: Nov. 9, 1999

[54] PICKS FOR STRINGED MUSICAL INSTRUMENTS

[76] Inventor: James L. Mapson, 26542 Broken Bit, Laguna Hills, Calif. 92653

[21] Appl. No.: 09/229,084

[22] Filed: Jan. 12, 1999

Related U.S. Application Data

[60] Division of application No. 08/763,677, Dec. 11, 1996, Pat. No. 5,864,075, which is a continuation-in-part of application No. 08/553,155, Nov. 7, 1995, abandoned.

[51] Int. Cl.[6] ..... G10D 3/16

[52] U.S. Cl. ..... 84/322; D17/20

[58] Field of Search ..... 84/322; D17/22

[56] References Cited

U.S. PATENT DOCUMENTS

| | | | |
|---|---|---|---|
| 1,787,136 | 12/1930 | Beauchamp | 84/322 |
| 4,102,234 | 7/1978 | Brundage | 84/322 |
| 4,270,433 | 6/1981 | Adamec | 84/322 |

*Primary Examiner*—Jeffrey Donels

*Attorney, Agent, or Firm*—Morland C. Fischer

[57] ABSTRACT

A pick to be used by a musician for plucking or strumming the strings of a musical instrument. According to one embodiment of the invention, a finger pick is disclosed having a body to be located against the fingertip and two pairs of flexible wrap-around arms that encircle the finger in spaced alignment with one another for retaining the pick on the musician's finger. The body of the finger pick may be canted relative to the longitudinal axis thereof so that the hand of the musician need not be contorted during play. The body of the finger pick may also contain a relatively large void that is surrounded by a narrow peripheral edge. According to a second embodiment, a thumb pick is disclosed having a flat blade and a flexible wrap-around arm that encircles the thumb for retaining the pick on the musician's thumb. The blade may be made of plastic and the wrap-around arm may be made of metal and contain a relatively large void that is surrounded by a narrow peripheral edge. The blade may also be pivotally attached to the wrap-around arm by an eyelet and have a dimple rising out of the string facing side thereof to engage the strings of the instrument during play.

11 Claims, 5 Drawing Sheets

Fig. 5
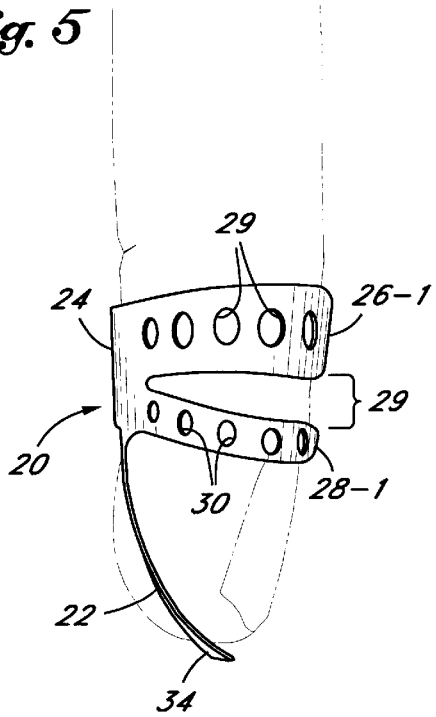
Fig. 6
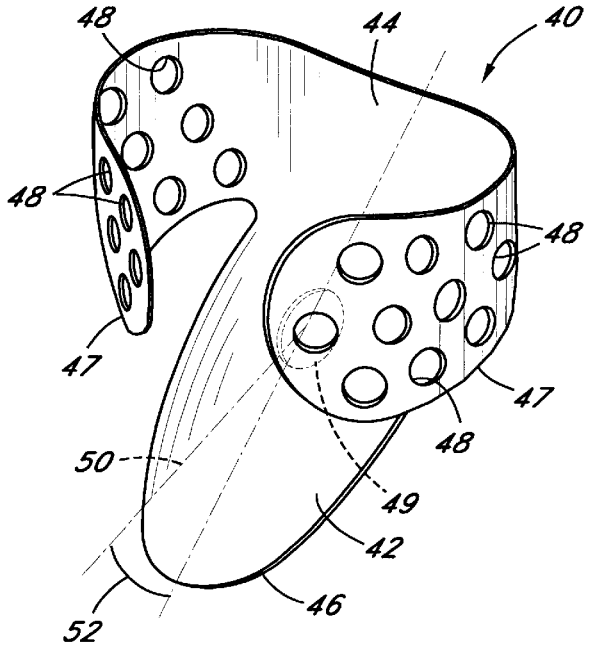
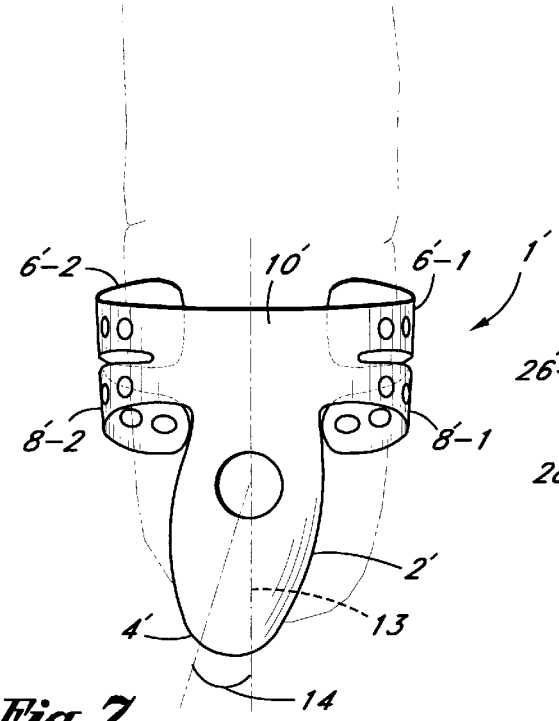
Fig. 7
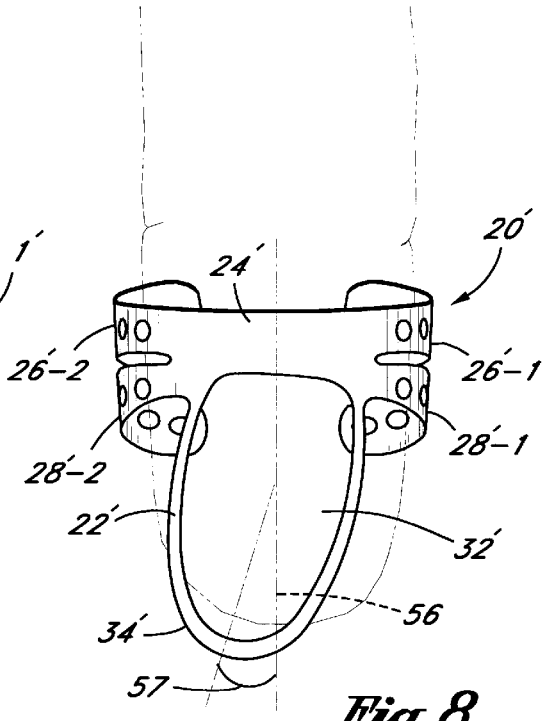
Fig. 8

PICKS FOR STRINGED MUSICAL INSTRUMENTS

CROSS REFERENCES TO RELATED PATENT APPLICATIONS

This application is a division of application Ser. No. 08/763,677 filed Dec. 11, 1996, now U.S. Pat. No. 5,864,075, which is a continuation-in-part of application Ser. No. 08/553,155 filed Nov. 7, 1995, now abandoned.

BACKGROUND OF THE INVENTION

1. Field of the Invention

This invention relates to finger and thumb picks to be worn by a musician to pluck or strum the strings of a musical instrument.

2. Background Art

Finger picks and thumb picks have long been used by musicians as an alternative to using one's fingers and/or fingernails to pluck or strum the strings of a musical instrument. However, there are certain inherent shortcomings with conventional picks. Most importantly, it has been difficult to reliably attach the same pick to a variety of different fingers and thumbs having different shapes so as to prevent the pick from sliding during play. Moreover, the construction of the conventional finger pick having a longitudinally aligned body or tongue may lead to early finger fatigue because the user is often required to contort his hand in an unnatural position in order to pluck all of the strings of some instruments. Moreover, it has sometimes been difficult for the musician to obtain consistent tone quality and high volume when using conventional finger and thumb picks. This problem is particularly acute when the user moves his thumb through an arc to pluck all of the strings such that a different part of the thumb pick will impact each of the strings.

Examples of conventional finger and thumb picks for playing stringed musical instruments are available by referring to one or more of the following United States patents:

| | | |
|---|---|---|
| 401,476 | N.E. Barnes | April 16, 1889 |
| 413,579 | S.S. Stewart | October 22, 1889 |
| 566,806 | G.B. Shearer | September 1, 1896 |
| 1,296,284 | H.K. Gilman | March 4, 1919 |
| 1,787,136 | G.D. Beauchamp | December 30, 1930 |
| 2,016,438 | Y.K. Kealoha | October 8, 1935 |
| 3,739,681 | J. Dunlop | June 19, 1973 |

SUMMARY OF THE INVENTION

According to a first embodiment of this invention, a finger pick is disclosed for plucking or strumming the strings of a musical instrument. The finger pick has a frontal crown and a body depending downwardly from the crown to be located against the tip of a user's finger. First and second pairs of flexible finger retaining arms, located one above the other, extend in opposite directions from the crown and bend towards one another to surround the finger. Each arm of the first and second pairs of arms has a series of perforations formed therein so that the arms can be bent to wrap around the user's finger and conform to the shape thereof The body of the finger pick depending downwardly from the crown may be canted relative to the longitudinal axis of the pick so as to avoid an unnatural contortion of the user's hand during play. Moreover, the body of the pick may also have a narrow peripheral edge surrounding a relatively large evacuated area through which the flesh of the finger is received so that the user may selectively vary the tone in a consistent manner when a string is plucked.

According to a second embodiment of this invention, a thumb pick is disclosed for plucking or strumming the strings of a musical instrument. The thumb pick has a flat blade and a flexible thumb retaining arm first extending away from the blade and then bending towards the blade in order to surround the thumb. The retaining arm can be bent to wrap around the user's thumb and conform to the shape thereof. The retaining arm has a narrow peripheral edge surrounding a relatively large evacuated area through which the flesh of the thumb is received. The blade of the thumb pick can be manufactured from plastic, while the retaining arm can be manufactured from metal and affixed to the blade by small rivets. A dimple rises out of the string facing side of the blade to assure a constant contact surface between the blade and the strings to be plucked. The blade can be pivotally attached to the retaining arm by means of an eyelet so that the angle of the blade can be selectively adjusted by simply rotating the blade around the eyelet.

BRIEF DESCRIPTION OF THE DRAWINGS

FIG. 5 is a side view of the finger pick of FIG. 4;

FIG. 6 is a perspective view of a finger pick according to another alternate embodiment of this invention;

FIG. 7 is a front view of the finger pick of FIG. 6 surrounding the finger of a musician;

FIG. 8 is a front view of a finger pick according to yet another alternate embodiment of this invention;

DETAILED DESCRIPTION

Figure 1:
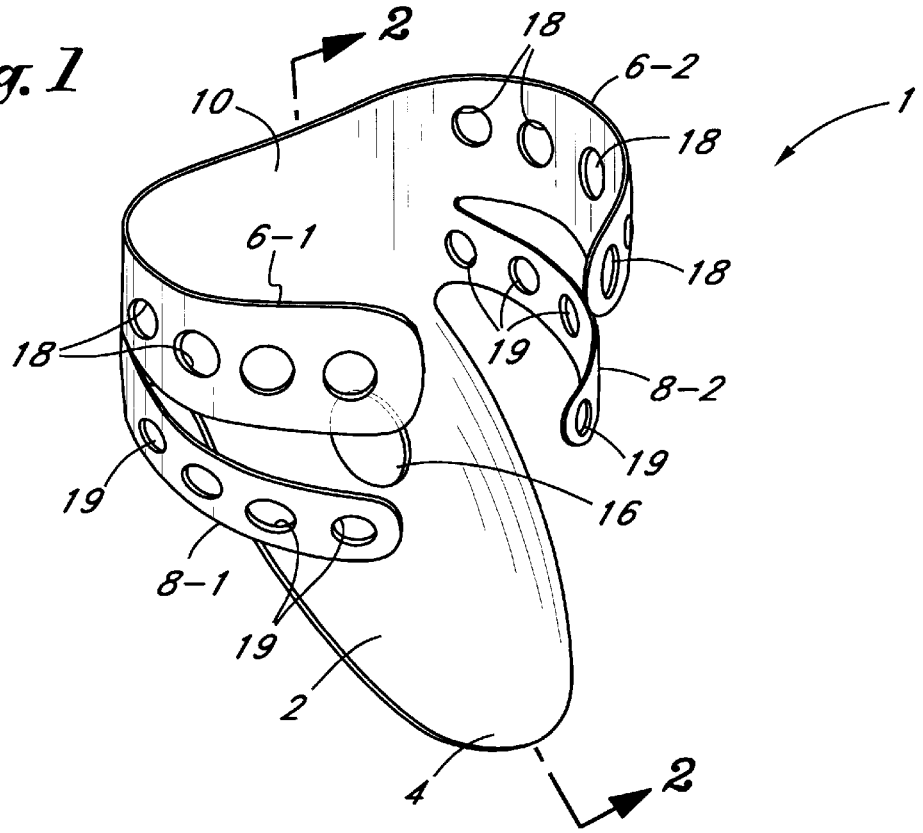
FIG. 1 is a perspective view of a finger pick according to a first embodiment of this invention.
Figure 2:
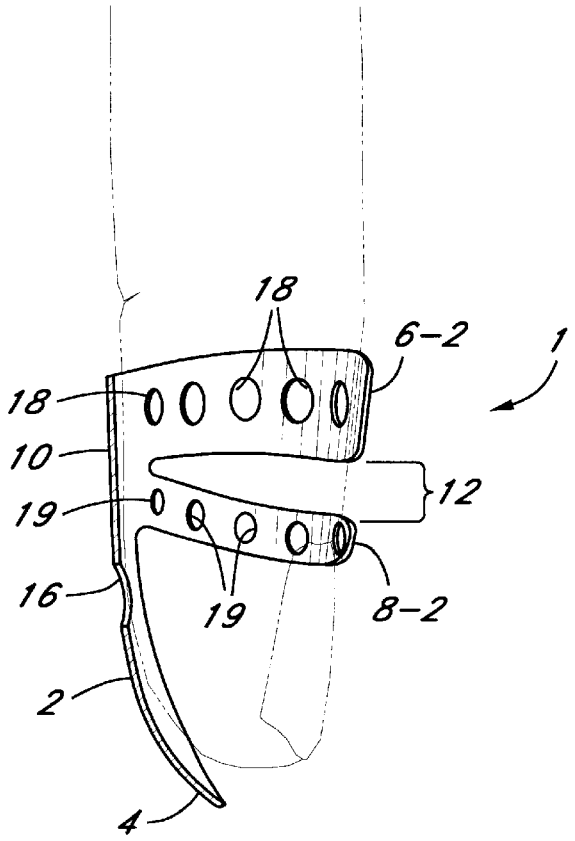
FIG. 2 is a cross-section taken along lines 2—2 of FIG. 1.

A finger pick 1 according to a first embodiment of this invention is described while referring to FIGS. 1 and 2 of the drawings. It is to be understood that the finger pick 1 has particular application for comfortably surrounding and reliably gripping one of the fingers (e.g. the index finger) of a musician wishing to pluck or strum the strings of a stringed instrument such as a guitar, banjo, harp, and the like. The finger pick 1 is preferably manufactured from a flexible metal (e.g. aluminum), although the material from which pick 1 is manufactured is not to be considered a limitation of this embodiment.

Finger pick 1 includes an elongated body or tongue 2 that, when the pick is properly secured to the user's finger, will extend axially along and cover the tip of the user's finger. To this end, the body 2 of pick 1 is slightly domed so as to better surround the user's finger tip. The body 2 of finger pick 1 tapers into a relatively narrow picking tip 4 at which the strings of the instrument are plucked or strummed.

As an important aspect of the first embodiment, top-most and bottom-most pairs of arms or wings 6-1, 6-2 and 8-1, 8-2 are coextensively joined to the body 2 of pick 1 by means of a crown 10 at the front of pick 1. More particularly, the body 2 of pick 1 depends downwardly from the frontal crown 10, and each arm 6-1, 6-2 and 8-1, 8-2 from the top-most and bottom-most pairs of arms projects laterally and in opposite directions from the crown 10. The arms 6-1, 6-2 and 8-1, 8-2 of each pair thereof then bend rearwardly and turn towards one another at the back of the pick 1 to form annular (i.e. wrap around) finger gripping rings that may be selectively adjusted (i.e. bent) to hold the finger pick 1 on the finger of the user.

As is best shown in FIG. 2, one of the top-most and one of the bottom-most arms (e.g. 6-2 and 8-2) from each pair of arms projecting from the crown 10 of finger pick 1 are aligned relative to one another so that a small angle (designated by reference numeral 12) of, for example, approximately 15 degrees is established therebetween. As is also shown in FIG. 2, the top-most pair of arms 6-1 and 6-2 are wider than the bottom-most pair of arms 8-1 and 8-2 (by about two to one). Moreover, and as is best shown in FIG. 1, the arms 6-1, 6-2 and 8-1, 8-2 from each pair of arms are bent towards one another at the back of the pick 1 so that small gaps are formed between the opposing ends thereof to facilitate the adjustment of the finger encircling rings to accommodate fingers of different size.

A round perforation 16 having a relatively large diameter is formed through the body 2 of pick 1 at approximately the mid-point thereof. A series of round perforations 18 and 19 is respectively formed along each of the arms 6-1, 6-2 and 8-1, 8-2 of the top-most and bottom-most pairs. The diameter of each of the perforations 19 through the relatively narrow bottom-most arms 8-1 and 8-2 is of constant size. However, the diameters of the series of perforations 18 through the relatively wide top-most arms 6-1 and 6-2 successively increase as the location of the perforations 18 moves further away from the crown 10 from which the arms 6-1 and 6-2 project. The advantage of providing each of the arms 6-1, 6-2 and 8-1, 8-2 with a series of perforations 18 and 19 is that the user can more easily and accurately bend the arms to conform to the shape of any finger and thereby avoid the faceting that has been known to occur when conventional finger picks having a relative few or no perforations are bent around the user's finger.

By virtue of the aforementioned split pairs of top-most and bottom-most finger encircling arms 6-1, 6-2 and 8-1, 8-2, the mechanical load that is produced when the finger pick 1 of this embodiment is used for plucking a string is more evenly distributed between the flesh of the finger and the fingernail of the user than the load distribution that is otherwise generated when a conventional finger pick is used having a single pair of wrap around arms. Therefore, not only will the user experience less finger fatigue during a long playing session, but the user can better feel the sensation of the string against his finger. What is even more, the top-most and bottom-most pairs of arms 6-1, 6-2 and 8-1, 8-2 and the small angle 12 therebetween permits a larger portion of the finger to be encircled, whereby to provide a better and more secure fit without applying excessive pressure against the flesh so that finger motion is more efficiently transmitted to the string. Similarly, two pairs of arms 6-1, 6-2 and 8-1, 8-2 of the finger pick 1 enable the size of the pick to be adjusted for use with a wider variety of finger shapes then that for which the conventional finger pick can be satisfactorily used.

Figure 3:
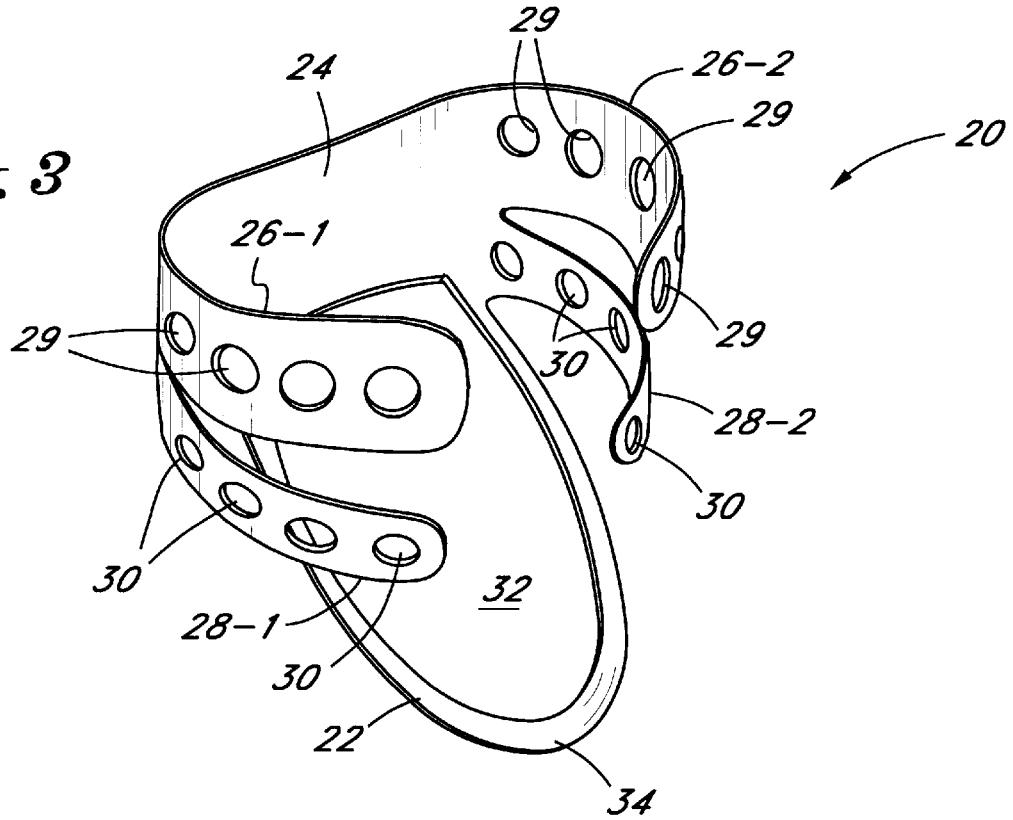
FIG. 3 is a perspective view of a finger pick according to an alternate embodiment of this invention.
Figure 4:
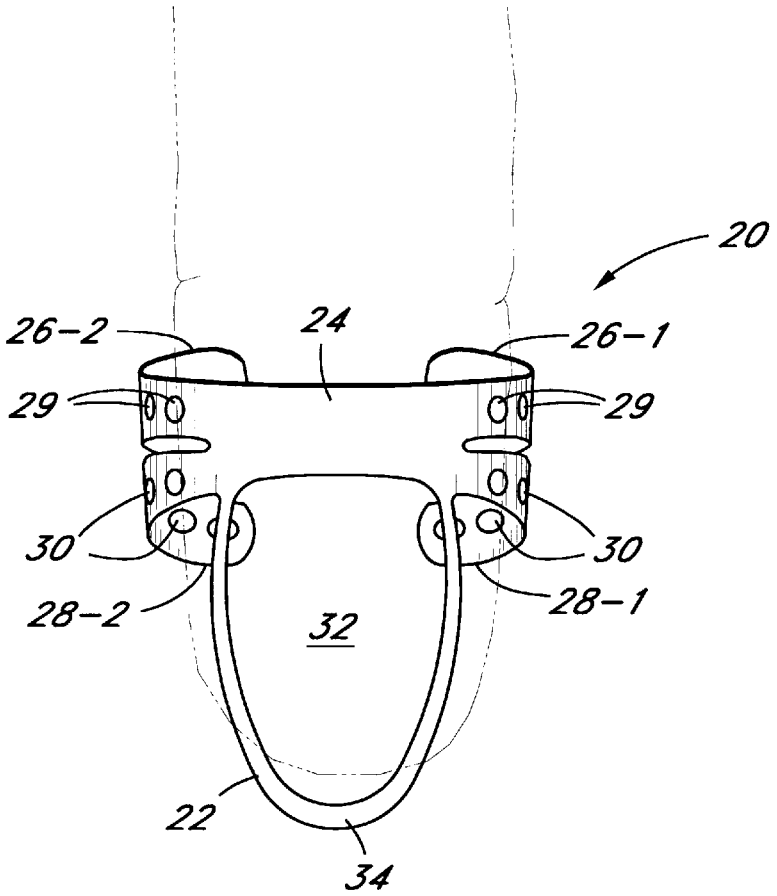
FIG. 4 is a front view of the finger pick of FIG. 3 surrounding the finger of a musician.

An alternate embodiment of the finger pick 1 of FIGS. 1 and 2 is now described while referring to FIGS. 3–5 of the drawings. The finger pick 20 of this embodiment is similar to the finger pick 1, although pick 20 includes a slightly wider body or tongue 22 that depends downwardly from a crown 24 at the front of the pick. Pairs of top-most and bottom-most arms 26-1, 26-2 and 28-1, 28-2 project laterally and in opposite directions from the frontal crown 24 towards the back of the pick 20 so as to form annular (i.e. wrap around) finger gripping rings to hold the finger pick 20 on the finger of the user. One of the top-most and one of the bottom-most arms (e.g. 26-1 and 28-1) from each pair of arms thereof projecting from the crown 24 are aligned relative to one another so that a small angle (designated 29 in FIG. 5) of, for example, approximately 15 degrees is established therebetween. A series of round perforations 30, each having the same diameter, is formed along each of the arms 28-1 and 28-2 of the bottom-most pair of arms. A series of round perforations 29, having successively larger diameters, is formed along each of the arms 26-1 and 26-2 of the top-most pair of arms.

However, and according to this embodiment, unlike the finger pick 1 in which a single round perforation 16 is formed at approximately the mid-point of the body 2, the body 22 of the finger pick 20 is hollow. More particularly, a large void or evacuated area 32 is established through the body 22 such that only a relatively thin peripheral edge remains to define a picking tip 34. By virtue of removing the majority of material from the body 22 of pick 20, the finger of the user will protrude through the void 32 (best shown in FIG. 5) which advantageously enables the user to pluck a string and create a relatively soft tone as if no pick were being used. Thus, the finger pick 20 of this embodiment has all of the advantages of the finger pick 1, as previously described, plus the additional advantage of being able to vary the tone from bright to muted, depending, in part, on the material from which the pick 20 is manufactured.

That is to say, the flesh of the finger will strike the string ahead of the picking tip 34 so as to provide a dampening effect, particularly when the user's fingers are rapidly plucking the strings. After the user's finger slides off the string, the picking tip 34 will finally touch the string much like a fingernail had no pick been used. However, in this case, the user's fingernail is shielded from the string and, therefore, is not subjected to the repetitive impact forces and wear as a consequence of constantly striking the strings. In addition, a more even and consistent tone accompanied by greater volume are available by using the finger pick 20 than would otherwise be available by merely using a fingernail that is subject to uneven wear over an extended period of play.

FIGS. 6–8 of the drawings show other alternate embodiments of this invention. Referring initially to FIG. 6, a finger pick 40 is shown including a slightly domed body or tongue 42 that depends downwardly from a crown 44 at the front of the pick. The body 42 of pick 40 tapers into a relatively narrow picking tip 46. A single pair of arms 47 projects laterally and in opposite directions from the frontal crown 44 towards the back of the pick 40 so as to form an annular (i.e. wrap around) finger gripping ring to hold the finger pick 40 on the finger of the user. A plurality of round perforations 48, each having an identical relatively small diameter, are evenly dispersed along the finger gripping arms 47 to enable the finger gripping ring to be easily and selectively adjusted (i.e. bent) to accurately conform to the shape of the user's finger. A single round perforation 49 having a relatively large diameter is formed through the body 42 at approximately the mid-point thereof.

In accordance with this embodiment, and continuing to refer to FIG. 6, the body 42 of finger pick 40 is canted sideways relative to a reference line 50 that runs axially along the pick 40 in parallel alignment with the longitudinal axis thereof. More particularly, the body 42 of finger pick 40 is rotated or bent at the crown 44 so as to establish an angle 52 of, for example, 10 degrees relative to the axially extending reference line 50. While the body 42 of the finger pick 40 of FIG. 6 is shown angled to one side of the reference line 50, the body 42 may also be angled to the opposite side of reference line 50, as well.

By virtue of the aforementioned canted body 42, the user is provided with the ability to establish a more natural hand position for playing a variety of stringed instruments, such as, for example, a lap/pedal guitar, a banjo, guitar, etc. That is to say, by angling the body 42 of finger pick 40 relative to the user's finger, the user will not have to contort his hand to properly align the pick at the string but can achieve a more comfortable position with respect to the string to be plucked without sacrificing tone quality. At the same time, the fatigue or trauma to which the user's finger will be subjected, particularly when the user has been playing over a number of years, can be minimized. To this end, it is to be understood that the angle 52 that is established between the body 42 and the axially extending reference line 50 can be varied depending upon the instrument to be played and the normal position of the user's hand with respect to the strings of the instrument so that different picks having different angles of cantation will be available to suit the needs of the user.

FIG. 7 of the drawings shows a finger pick 1' which is similar to the pick described while referring to FIGS. 1 and 2 of the drawings. However, the finger pick 1' includes the modification of the finger pick 40 shown in FIG. 6. More particularly, the finger pick 1' includes a body 2' depending downwardly from a crown 10' at the front of the pick. The body 2' tapers into a relatively narrow picking tip 4'. Pairs of top-most and bottom-most arms 6'-1, 6'-2 and 8'-1, 8'-2 project laterally and in opposite directions from the frontal crown 10' towards the back of pick 1' so as to form annular (i.e. wrap around) finger rings to hold the finger pick 1' on the finger of the user.

In accordance with the embodiment of FIG. 7, the body 2' of finger pick 1' is canted sideways relative to a reference line 14 that runs axially along the pick 1' in parallel alignment with the longitudinal axis thereof More particularly, the body 2' of finger pick 1' is rotated at the crown 10' so as to establish an angle 14 of, for example, approximately 10 degrees relative to the axially extending reference line 13. However, and as was described while referring to the finger pick 40 of FIG. 6, the aforementioned angle 14 established between the body 2' of finger pick 1' and the reference line 13 may be selectively varied depending upon the musical instrument to be played and the desired position of the user's hands relative to the strings of the instrument. Moreover, while the body 2' of finger pick 1' is angled towards the left of reference line 13, it is to be understood that body 2' may also be rotated at the crown 10' to the right of reference line 14 to meet the needs of the user depending upon the instrument to be played.

In accordance with the embodiment of FIG. 8, the body 22' of finger pick 20' is also canted sideways relative to a reference line 56 that runs axially along the pick 20' in parallel alignment with the longitudinal axis thereof. More particularly, the body 22' of finger pick 20' is rotated at the frontal crown 24' so as to establish an angle 57 of, for example, approximately 10 degrees relative to the axially extending reference line 56. However, and as indicated above, the aforementioned angle 57 established between the body 22' of finger pick 20' and the reference line 56 may be selectively varied depending upon the musical instrument to be played and the desired position of the user's hands relative to the strings of the instrument. Moreover, while the body 22' of finger pick 20' is angled towards the left of reference line 56, it is to be understood that body 22' may also be rotated from the crown 24' to the right of reference line 56 to meet the needs of the user depending upon the instrument to be played.

FIGS. 9–12 of the drawings show a thumb pick according to a second embodiment of this invention. While the finger picks disclosed when referring to FIGS. 1–8 surround a finger of the user, the thumb picks of FIGS. 9–12 have particular application for comfortably surrounding and reliably gripping the thumb of a user wishing to pluck or strum a string musical instrument.

Figure 9:
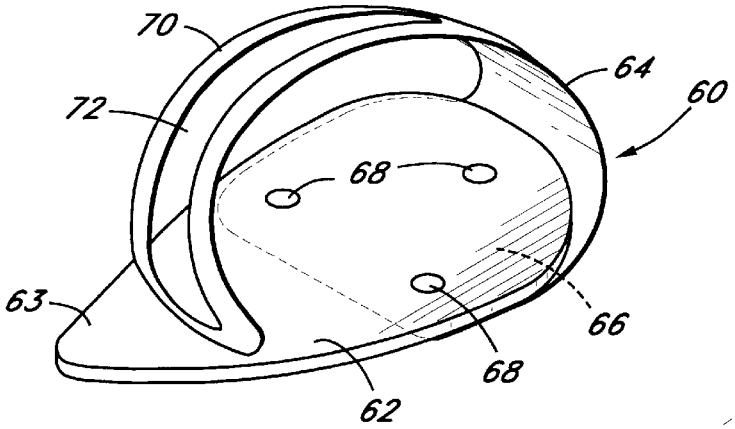
FIG. 9 is a perspective view of a thumb pick according to a second embodiment of this invention.
Figure 10:
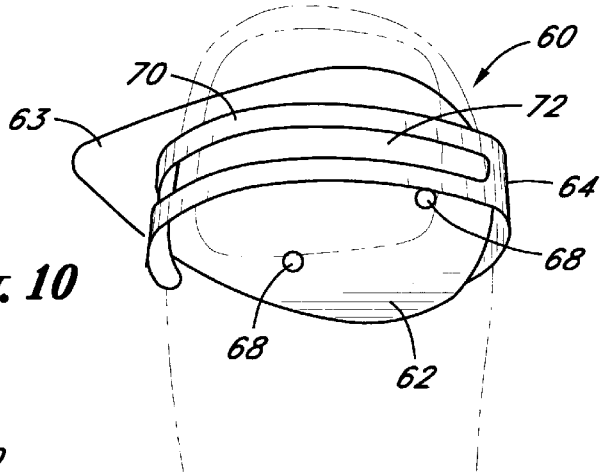
FIG. 10 is a rear view of the thumb pick of FIG. 9 surrounding the thumb of a musician.

Referring initially to the thumb pick 60 of FIGS. 9 and 10, there is shown a flat generally teardrop shaped blade 62. The blade 62 tapers into a relatively narrow picking tip 63 at which the strings of the instrument are plucked or strummed. The blade 62 of thumb pick 60 is preferably manufactured from a non-metallic material such as plastic. However, the precise non-metallic material from which the blade 62 is formed is not to be considered a limitation of this embodiment.

Affixed to the blade 62 is a generally arcuate thumb encircling retaining ring 64. Retaining ring 64 is manufactured from a flexible metal (e.g. aluminum) so that the shape thereof may be easily adjusted to conform to the thumb of the user. However, like the blade 62 of thumb pick 60, the precise flexible metallic material from which the retaining ring 64 is formed is not to be considered a limitation of this embodiment. Nevertheless, it should not be overlooked that the blade 62 and retaining ring 64 of thumb pick 60 are manufactured from two different materials, i.e. the blade 62 being formed from plastic and the retaining ring 64 being formed from metal, so as to provide the user with the dual benefits of a softer picking tone available from a non-metallic blade and a more secure fit available from a flexible (i.e. adjustable) metallic retaining ring.

The arcuate thumb encircling retaining ring 64 of thumb pick 60 includes a flat base 66 (best shown in FIG. 9) affixed to the outside of the blade 62 by means of suitable fasteners, such as small rivets 68, or the like. More particularly, the rivets 68 secure the flat base 66 of retaining ring 64 to the string facing side of blade 62 when the pick 60 is used. A domed, wrap-around wing 70 of retaining ring 64 first projects outwardly from the base 66 and away from the blade 62. The wing 70 then bends and gradually turns back towards the blade 62 so that a space is created between the wing 70 and the blade 62 in which to receive the thumb of the user (best shown in FIG. 10).

As an important feature of this embodiment, the wrap-around wing 70 from the finger encircling retaining ring 64 of thumb pick 60 is hollow. That is to say, a large void or evacuated area 72 is established through the wing 70 so that only a relatively thin peripheral edge remains to surround the thumb of the user. By virtue of removing the majority of material from the wrap-around wing 70, a more comfortable fit and a more reliable grip is possible between the thumb encircling retaining ring 64 and the thumb of the user. In this regard, the flesh below the thumbnail of the user will extend slightly into the void 72 of wrap-around wing 70 to minimize the compressive force to be applied against the thumb while, at the same time, preventing the thumb pick 60 from sliding along the thumb when the strings of the instrument are being plucked or strummed.

Figure 11:
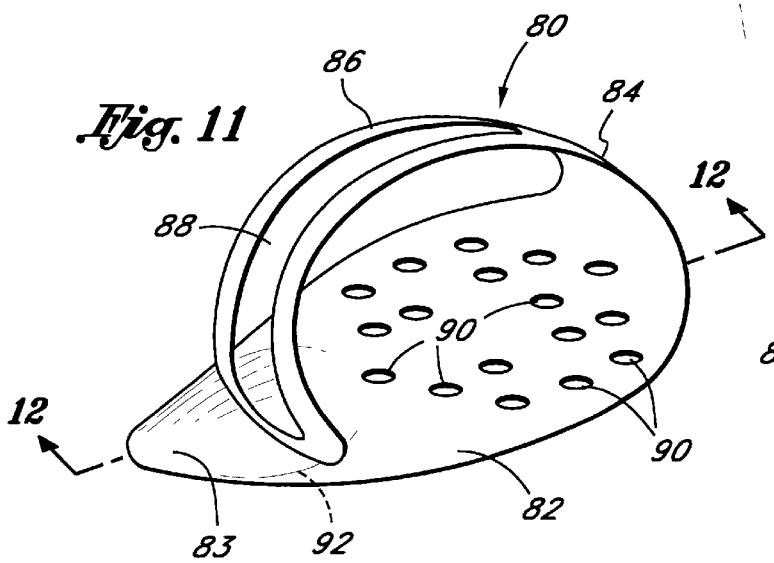
FIG. 11 is a perspective view of a thumb pick according to an alternate embodiment of this invention.
Figure 12:
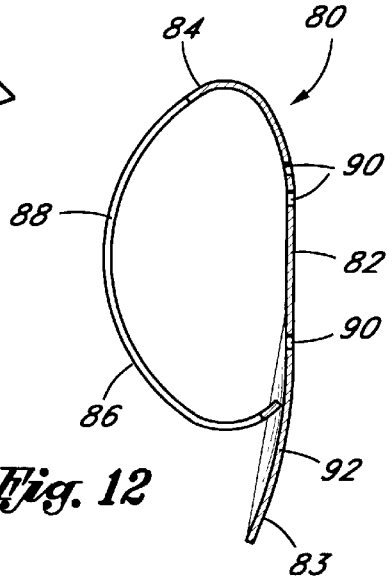
FIG. 12 is a cross-section taken along lines 12—12 of FIG. 11.

An alternate embodiment of the thumb pick 60 of FIGS. 9 and 10 is described while now referring to FIGS. 11 and 12 of the drawings. The thumb pick 80 of this embodiment is similar to the thumb pick 60 in that it includes a teardrop shaped blade 82 and an arcuate, thumb encircling retaining ring 84. The blade 82 of thumb pick 80 tapers into a relatively narrow picking tip 83. Moreover, the arcuate retaining ring 84 of thumb pick 80 includes a hollow, wrap-around wing 86 that attaches the pick to the thumb of the user. A large void 88 is established through the wing 86 so that only a relatively thin peripheral edge remains to surround the thumb whereby to offer a more comfortable fit and a more reliable grip of the user's thumb in the same manner offered by the thumb pick 60.

However, unlike the thumb pick 60 of FIGS. 9 and 10, the thumb pick 80 of FIGS. 11 and 12 is manufactured from a single flexible metallic material (e.g. aluminum) so that the blade 82 and the thumb encircling retaining ring 84 are coextensive to one another. Moreover, an array of round perforations 90 are evenly distributed along the blade 82 of thumb pick 60 above the picking tip 83 thereof. What is still more, and as an important advantage over conventional thumb picks, the thumb pick 80 includes a dimple (designated 92 and best shown in FIG. 12). The dimple 92 is disposed between the tip 83 and the array of perforations 90 in the blade 82 and rises out of the string facing side of blade 82 when the pick 80 is used.

By virtue of the dimple 92 of thumb pick 80, a wide range of thumb movement is possible while maintaining tangential (i.e. flat) contact between the blade 82 and the string of the instrument to be plucked. More particularly, as the user's thumb moves through a natural arc while sweeping across a string, the dimple 92 will operate as the primary contact point of the blade 82 against the string, which contact point remains tangentially aligned with respect to each of the strings to be plucked during play. The foregoing advantage results in less string noise because the strings of the instrument impact the dimple 92 and not the edge of the pick blade 82 as is otherwise common with conventional thumb picks. In this regard, not only is the dimple 92 useful in a thumb pick 80 manufactured from a single metallic material (like that shown in FIGS. 11 and 12), but similar dimples may also be incorporated into thumb picks manufactured from both metal and plastic (like that shown in FIGS. 9 and 10) or from a single plastic material (not shown).

Figure 13:
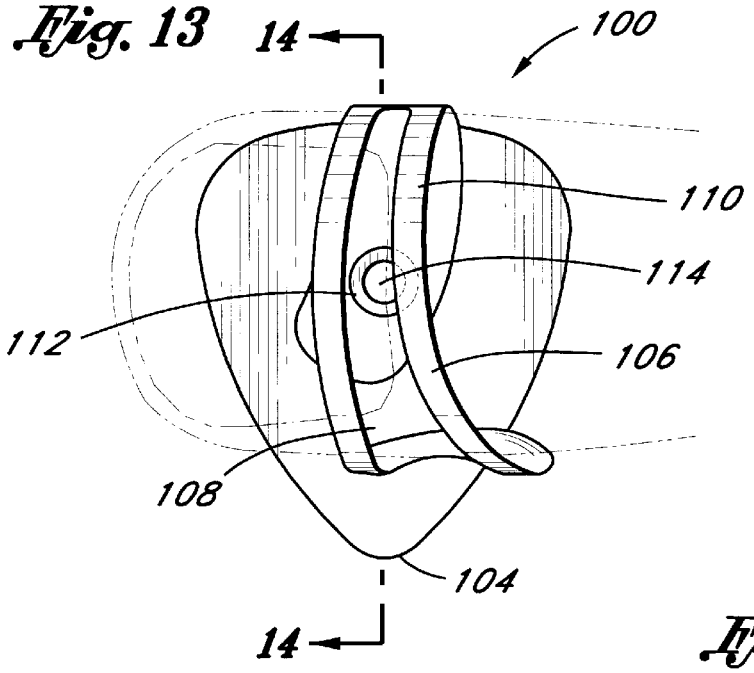
FIG. 13 is a rear view of a thumb pick according to an additional embodiment of this invention.
Figure 14:
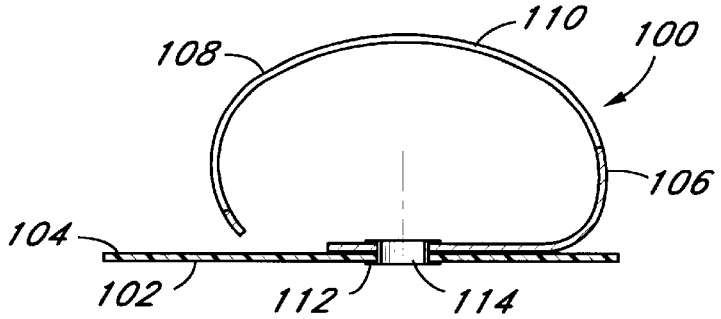
FIG. 14 is a cross section taken along lines 14—14 of FIG. 13.
Figure 15:
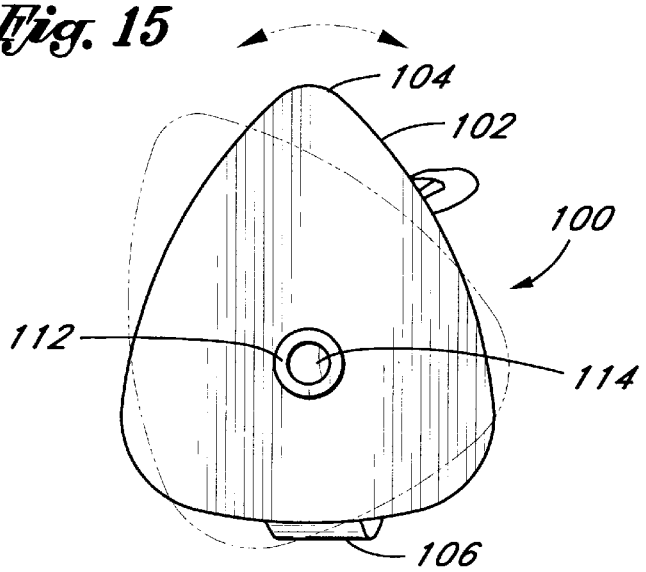
FIG. 15 is a front view of the thumb pick of FIG. 13.

FIGS. 13–15 of the drawings shows a thumb pick 100 having the unique advantage of an adjustable blade 102, the position of which can be selectively changed to provide the musician with the best feel and tone. More particularly, the thumb pick 100 includes a flat, generally tear drop shaped blade 102 that tapers into a relatively narrow picking tip 104. In the case of FIGS. 13–15, the blade 102 is manufactured from a non-metallic material, such as plastic.

Affixed to the blade 102 is a generally arcuate thumb encircling retaining ring 106. Retaining ring 106 is identical to the retaining ring 64 that was earlier described when referring to FIGS. 9 and 10 and, therefore, the ring 106 will not once again be described. Briefly, however, the retaining ring 106 is manufactured from a flexible metallic material (e.g. aluminum) whereby the thumb pick 100 includes a plastic blade 102 and a metallic retaining ring 106 to achieve the same advantages as that achieved by the thumb pick 60 of FIGS. 9 and 10 which was also manufactured from two different materials. Moreover, the finger encircling retaining ring 106 of thumb pick 100 also includes a relatively large void or evacuated area 108 running therealong so that only a thin peripheral edge 110 remains to surround the thumb of the musician. The evacuated area 108 through retaining ring 106 provides for both a comfortable fit and a reliable attachment to the musician's thumb.

In accordance with this embodiment, the blade 102 of thumb pick 100 is pivotally attached to one end of the thumb encircling retaining ring 106 by means of an eyelet 112. In this regard, the blade 102 of thumb pick 100 has a centrally disposed hole 114 formed therethrough to accommodate the eyelet 112. To maximize comfort, the eyelet 112 should lie flush against the flesh of the user's thumb. Therefore, the head of the eyelet 112 will be recessed within a circular cavity (e.g. a counterbore) formed in the end of the retaining ring 106 to which eyelet 112 is attached.

Thus, the position of the blade 102 of thumb pick 100 can be angled by simply rotating the blade around the eyelet 112 (best shown in phantom lines in FIG. 15). By virtue of the foregoing, the thumb pick 100 is suitable to be used by different musicians to play a variety of different stringed instruments. What is more, by being able to adjust the angle of the blade 102, the thumb pick 100 can be used to play finger style or as a replacement for the more traditional flat pick in order to strum the strings of an instrument. However, with the retaining ring 106 reliably located around the thumb, a musician is much less likely to accidentally drop the thumb pick 100 of this invention than a flat pick which is gripped between the thumb and fingers.

It will be apparent that while the preferred embodiments of this invention have been shown and described, various modifications and changes may be made without departing from the true spirit and scope of the invention. Having thus set forth the preferred embodiments, what is claimed is:

1. A pick to be attached to a finger of a user for plucking or strumming the strings of a musical instrument, said pick having a longitudinal axis and comprising a crown, a body depending from said crown so as to cover the tip of the finger, and annular finger retaining means to hold said pick on the finger during play, said annular finger retaining means including a first pair of arms extending in opposite directions from said crown and bending towards one another to surround the finger and a second pair of arms extending in opposite directions from said crown and bending towards one another to surround the finger, each of said first and second pairs of arms being flexible to conform to the shape of the finger and wrap around the finger, with said first pair of arms located above the said second pair of arms in spaced alignment therewith.

2. The pick recited in claim 1, wherein one of said arms from said first pair of arms is arranged in spaced alignment with one of said arms from said second pair of arms so that an angle is formed therebetween.

3. The pick recited in claim 1, further comprising a series of perforations formed in each arm of said first and second pairs of arms to facilitate bending said arms to conform to the shape of the user's finger.

4. The pick recited in claim 1, wherein each arm from said first pair of arms is wider than each arm from said second pair of arms.

5. The pick recited in claim 1, wherein said body depending from said crown is canted relative to the direction of the longitudinal axis of said pick.

6. The pick recited in claim 1, wherein said body depending from said crown includes a peripheral edge of material surrounding an evacuated area in which to receive some of the finger, said evacuated area forming a majority of the total area of said body.

7. The pick recited in claim 6, wherein said body is canted relative to the direction of the longitudinal axis of said pick.

8. A pick to be attached to a finger of a user for plucking or strumming the strings of a musical instrument, said pick having a longitudinal axis and comprising a crown including a front, a back and a pair of opposite sides, a body depending from said crown between the pair of opposite sides thereof so as to cover the tip of the finger, said body being canted relative to said longitudinal axis in a direction towards one of the pair of opposite sides of said crown, and annular finger retaining means to hold said pick on the finger during play, said annular finger retaining means including at least one pair of arms extending in opposite directions from respective ones of the pair of opposite sides of said crown and bending towards one another to surround the finger, said at least one pair of arms being flexible so as to wrap around the finger and conform to the shape of the finger.

9. The pick recited in claim 8, further comprising a series of perforations formed in each arm of said at least one pair of arms to facilitate bending said arms to conform to the shape of the user's finger.

10. The pick recited in claim 8, wherein said body is canted relative to said longitudinal axis so as to bend ahead of the front of said crown and towards one of the pair of opposite sides of said crown.

11. A pick to be attached to a thumb of a user for plucking or strumming the strings of a musical instrument, said pick comprising a blade and annular finger retaining means to hold said pick on the thumb during play, said annular finger retaining means including a wing depending away from said blade and then bending towards said blade to surround the thumb, said wing being flexible so as to wrap around the thumb and conform to the shape of the thumb, and said blade having a dimple rising outwardly therefrom so as to strike the strings of the instrument to be plucked or strummed.

* * * * *